US010011893B2

(12) United States Patent
Kim et al.

(10) Patent No.: US 10,011,893 B2
(45) Date of Patent: Jul. 3, 2018

(54) FERRITIC/MARTENSITIC OXIDE DISPERSION STRENGTHENED STEEL WITH ENHANCED CREEP RESISTANCE AND METHOD OF MANUFACTURING THE SAME

(71) Applicant: Korea Atomic Energy Research Institute, Daejeon (KR)

(72) Inventors: Tae Kyu Kim, Daejeon (KR); Sanghoon Noh, Busan (KR); Byoung-Kwon Choi, Daejeon (KR); Ki-Baik Kim, Daejeon (KR); Yong-Hwan Jeong, Daejeon (KR)

(73) Assignee: Korea Atomic Energy Research Institute, Daejeon (KR)

( * ) Notice: Subject to any disclaimer, the term of this patent is extended or adjusted under 35 U.S.C. 154(b) by 1171 days.

(21) Appl. No.: 14/485,409

(22) Filed: Sep. 12, 2014

(65) Prior Publication Data

US 2015/0252458 A1 Sep. 10, 2015

(30) Foreign Application Priority Data

Mar. 5, 2014 (KR) ..... 10-2014-0025971

(51) Int. Cl.
*C22C 38/18* (2006.01)
*C22C 38/50* (2006.01)
(Continued)

(52) U.S. Cl.
CPC ..... *C22C 38/50* (2013.01); *B22F 3/12* (2013.01); *B22F 3/1208* (2013.01); *B22F 3/15* (2013.01);
(Continued)

(58) Field of Classification Search
CPC ..... C22C 38/50; C22C 33/0285; C22C 38/44; C22C 38/28; C22C 38/22; C22C 38/04;
(Continued)

(56) References Cited

U.S. PATENT DOCUMENTS 3,728,088 A * 4/1973 Benjamin ..... B22F 9/04 75/233
3,785,801 A * 1/1974 Benjamin ..... B22F 9/04 419/1
(Continued)

FOREIGN PATENT DOCUMENTS

JP 01-287252 A 11/1989
JP 02-225648 A * 7/1990
(Continued)

OTHER PUBLICATIONS

Translation of JP-1287252A (no date available).*
(Continued)

*Primary Examiner* — Kiley Stoner
(74) *Attorney, Agent, or Firm* — Knobbe Martens Olson & Bear LLP

(57) ABSTRACT

Provided are a ferritic/martensitic oxide dispersion strengthened steel with increased high temperature creep resistance, including 0.02 to 0.2 wt % of carbon (C), 8 to 12 wt % of chromium (Cr), 0.1 to 0.5 wt % of yttria ($Y_2O_3$), 0.2 to 2 wt % of molybdenum (Mo), 0.01 to 0.5 wt % of titanium (Ti), 0.01 to 1 wt % of manganese (Mn), 0.01 to 0.3 wt % of vanadium (V), 0 to 0.3 wt % of zirconium (Zr), 0 to 0.5 wt % of nickel (Ni), and the remaining content of iron (Fe), and a method of manufacturing the same. The ferritic/martensitic oxide dispersion strengthened steel may be useful as a material for core structural components of a nuclear power system, ultra supercritical pressure steam generator components of a thermal power plant, or engine components of an
(Continued)

| Test temp. | Tensile characteristics | Reference alloy | New alloy 1 | New alloy 2 | New alloy 3 | New alloy 4 |
|---|---|---|---|---|---|---|
| Room temp. | Yield strength (MPa) | 916 | 913 | 917 | 921 | 927 |
| | Maximum tensile strength (MPa) | 1035 | 1077 | 1081 | 1091 | 1097 |
| | Total elongation (%) | 9.5 | 10.1 | 10.1 | 10.3 | 10.1 |
| 700°C | Yield strength (MPa) | 150 | 197 | 192 | 193 | 210 |
| | Maximum tensile strength (MPa) | 193 | 237 | 231 | 237 | 245 |
| | Total elongation (%) | 30 | 31 | 29 | 31 | 31 |

airplane due to a high tensile strength at 700° C. and excellent creep resistance.

3 Claims, 3 Drawing Sheets

(51) Int. Cl.

| | |
|---|---|
| ***B22F 3/12*** | (2006.01) |
| ***B22F 3/15*** | (2006.01) |
| ***B22F 3/17*** | (2006.01) |
| ***B22F 5/00*** | (2006.01) |
| ***B22F 5/10*** | (2006.01) |
| ***B22F 9/04*** | (2006.01) |
| ***C22C 33/02*** | (2006.01) |
| ***C22C 38/04*** | (2006.01) |
| ***C22C 38/22*** | (2006.01) |
| ***C22C 38/28*** | (2006.01) |
| ***C22C 38/44*** | (2006.01) |
| ***C22C 38/46*** | (2006.01) |
| ***B22F 5/12*** | (2006.01) |
| *B22F 3/18* | (2006.01) |
| *B22F 3/20* | (2006.01) |

(52) U.S. Cl.
CPC ..... *B22F 3/17* (2013.01); *B22F 5/00* (2013.01); *B22F 5/009* (2013.01); *B22F 5/10* (2013.01); *B22F 5/12* (2013.01); *B22F 9/04* (2013.01); *C22C 33/0285* (2013.01); *C22C 38/04* (2013.01); *C22C 38/22* (2013.01); *C22C 38/28* (2013.01); *C22C 38/44* (2013.01); *C22C 38/46* (2013.01); *B22F 3/18* (2013.01); *B22F 3/20* (2013.01); *B22F 2003/185* (2013.01); *B22F 2003/208* (2013.01); *B22F 2009/041* (2013.01); *B22F 2998/10* (2013.01)

(58) Field of Classification Search
CPC C22C 38/46; C22C 33/00–38/60; B22F 5/12; B22F 3/17; B22F 3/1208; B22F 3/12; B22F 9/04; B22F 5/10; B22F 5/009; B22F 5/00; B22F 3/15; B22F 2998/10; B22F 3/20; B22F 2003/185; B22F 2009/041; B22F 3/18; B22F 2003/208
USPC ..... 420/8–129; 419/19
See application file for complete search history.

(56) References Cited

U.S. PATENT DOCUMENTS

| | | | | | |
|---|---|---|---|---|---|
| 3,809,545 | A * | 5/1974 | Benjamin | B22F 9/04 | 75/235 |
| 4,443,249 | A * | 4/1984 | Weber | B02C 17/16 | 148/513 |
| 4,627,959 | A * | 12/1986 | Gilman | B22F 9/04 | 241/26 |
| 4,960,562 | A * | 10/1990 | Okuda | C22C 32/0026 | 29/723 |
| 4,963,200 | A | 10/1990 | Okuda et al. | | |
| 7,141,209 | B2 * | 11/2006 | Kaito | B22F 3/16 | 419/28 |
| 7,273,584 | B2 * | 9/2007 | Ohtsuka | C21D 6/002 | 419/19 |
| 2015/0275337 | A1 * | 10/2015 | Mariani | C22C 32/0026 | 419/20 |

FOREIGN PATENT DOCUMENTS

| | | | |
|---|---|---|---|
| JP | 08-225891 | A | 9/1996 |
| JP | 11-343526 | A | 12/1999 |
| JP | 2002-266026 | A | 9/2002 |

OTHER PUBLICATIONS

Office Action dated Aug. 7, 2015 of corresponding Korean Patent Application No. 10-2014-0025971 and its English translation—11 pages.
Office Action dated Jul. 28, 2015 corresponding to Japanese Patent Application No. 2014-187580—6 pages.

* cited by examiner

FIG. 2

| Test temp. | Tensile characteristics | Reference alloy | New alloy 1 | New alloy 2 | New alloy 3 | New alloy 4 |
|---|---|---|---|---|---|---|
| Room temp. | Yield strength (MPa) | 916 | 913 | 917 | 921 | 927 |
| | Maximum tensile strength (MPa) | 1035 | 1077 | 1081 | 1091 | 1097 |
| | Total elongation (%) | 9.5 | 10.1 | 10.1 | 10.3 | 10.1 |
| 700°C | Yield strength (MPa) | 150 | 197 | 192 | 193 | 210 |
| | Maximum tensile strength (MPa) | 193 | 237 | 231 | 237 | 245 |
| | Total elongation (%) | 30 | 31 | 29 | 31 | 31 |

FIG. 3

| Condition for creep test | | Creep breaking time (h) | | | | |
|---|---|---|---|---|---|---|
| Test temp. | Loading stress | Reference alloy | New alloy 1 | New alloy 2 | New alloy 3 | New alloy 4 |
| 700°C | 120 MPa | 18.6 | 51.7 | 57.0 | 68.7 | 88.9 |
| 700°C | 150 MPa | 3.1 | 11.1 | 12.4 | 13.1 | 15.1 |

FERRITIC/MARTENSITIC OXIDE DISPERSION STRENGTHENED STEEL WITH ENHANCED CREEP RESISTANCE AND METHOD OF MANUFACTURING THE SAME

CROSS-REFERENCE TO RELATED APPLICATION

This application claims priority to and the benefit of Korean Patent Application No. 2014-0025971, filed on Mar. 5, 2014, the disclosure of which is incorporated herein by reference in its entirety.

BACKGROUND

1. Field

The present disclosure relates to ferritic/martensitic oxide dispersion strengthened steel with enhanced creep resistance and a method of manufacturing the same.

2. Discussion of Related Art

An iron (Fe)-chromium (Cr) alloy in which chromium is added to iron at 8 to 12 wt % is generally normalized and tempered, thereby forming a tempered martensite structure. Such a high chrome alloy is used as a material for a structural component of a nuclear power system such as sodium-cooled fast reactor or a thermoelectric power plant due to excellent neutron radiation resistance at a high temperature and an excellent mechanical property. However, there is a limit to a temperature at which the alloy is used as a structural material due to drastic reduction in tensile stress and creep strength at a high temperature such as 600° C. or more. Alternatively, oxide dispersion strengthened steel with an enhanced mechanical property at a high temperature by dispersing an oxide in an alloy matrix is being developed. Oxide dispersion strengthened steel is an alloy in which a nano oxide with excellent thermal stability such as yttria ($Y_2O_3$) is uniformly dispersed in an iron (Fe)-chromium (Cr)-based alloy matrix, which is enhanced in high temperature mechanical property such as a creep strength, compared to a general alloy, due to dispersion strengthening of an oxide as well as solid solution strengthening of a matrix structure.

Generally, oxide dispersion strengthened steel has excellent high temperature strength compared to a general alloy, but a condition for designing was not still sufficiently satisfied. To improve such a problem, an alloy atom such as tungsten (W), tantalum (Ta), or niobium (Nb) is added to an iron (Fe)-chromium (Cr)-yttria ($Y_2O_3$)-based alloy. However, when oxide dispersion strengthened steel in which tungsten (W) is added as a solid solution strengthening element is used under a high temperature stress atmosphere for a long time, a Laves phase such as brittle $(Fe,Cr)_2W$ is produced, and thus a long-term creep characteristic is considerably decreased.

SUMMARY

Aspects of the present invention are directed to ferritic/martensitic oxide dispersion strengthened steel with enhanced creep resistance, which is mainly composed of an Fe—Cr—$Y_2O_3$-based alloy, and includes carbon (C) at 0.02 to 0.2 wt %, chromium (Cr) at 8 to 12 wt %, yttria ($Y_2O_3$) at 0.1 to 0.5 wt %, molybdenum (Mo) at 0.2 to 2 wt %, titanium (Ti) at 0.01 to 0.5 wt %, manganese (Mn) at 0.01 to 1 wt %, vanadium (V) at 0.01 to 0.3 wt %, zirconium (Zr) at more than 0 to 0.3 wt % or less, nickel (Ni) at more than 0 to 0.5 wt % or less, and iron (Fe) at the remaining content, and a method of manufacturing the same.

However, aspects of the present invention are not limited to the aspect described above, and other aspects not described herein will be clearly understood by those of ordinary skill in the art from the following descriptions.

According to an aspect of the present invention, ferritic/martensitic oxide dispersion strengthened steel with excellent creep resistance, which includes carbon (C) at 0.02 to 0.2 wt %, chromium (Cr) at 8 to 12 wt %, yttria ($Y_2O_3$) at 0.1 to 0.5 wt %, molybdenum (Mo) at 0.2 to 2 wt %, titanium (Ti) at 0.01 to 0.5 wt %, manganese (Mn) at 0.01 to 1 wt %, vanadium (V) at 0.01 to 0.3 wt %, and iron (Fe) at the remaining content, is provided.

According to another aspect of the present invention, a method of manufacturing ferritic/martensitic oxide dispersion strengthened steel with excellent creep resistance is provided, which includes (a) preparing alloy powder by mixing metal powder including carbon (C), chromium (Cr), molybdenum (Mo), titanium (Ti), manganese (Mn), vanadium (V), and iron (Fe) with yttria ($Y_2O_3$) powder and treating the resulting mixture by mechanical alloying; (b) charging the mechanically-alloyed alloy powder into a can container and performing degassing; (c) preparing oxide dispersion strengthened steel by hot-working the degassed alloy powder; and (d) cold-working the hot-worked oxide dispersion strengthened steel.

BRIEF DESCRIPTION OF THE DRAWINGS

The above and other features and advantages of the present invention will become more apparent to those of ordinary skill in the art by describing in detail embodiments thereof with reference to the accompanying drawings, in which:

FIG. 2 is a diagram showing tensile test results for typical oxide dispersion strengthened steel and ferritic/martensitic oxide dispersion strengthened steel according to embodiments of the present invention at room temperature and 700° C.; and FIG. 3 shows creep test results for typical oxide dispersion strengthened steel and ferritic/martensitic oxide dispersion strengthened steel according to embodiments of the present invention at 700° C.

DETAILED DESCRIPTION OF EMBODIMENTS

Figure 1:
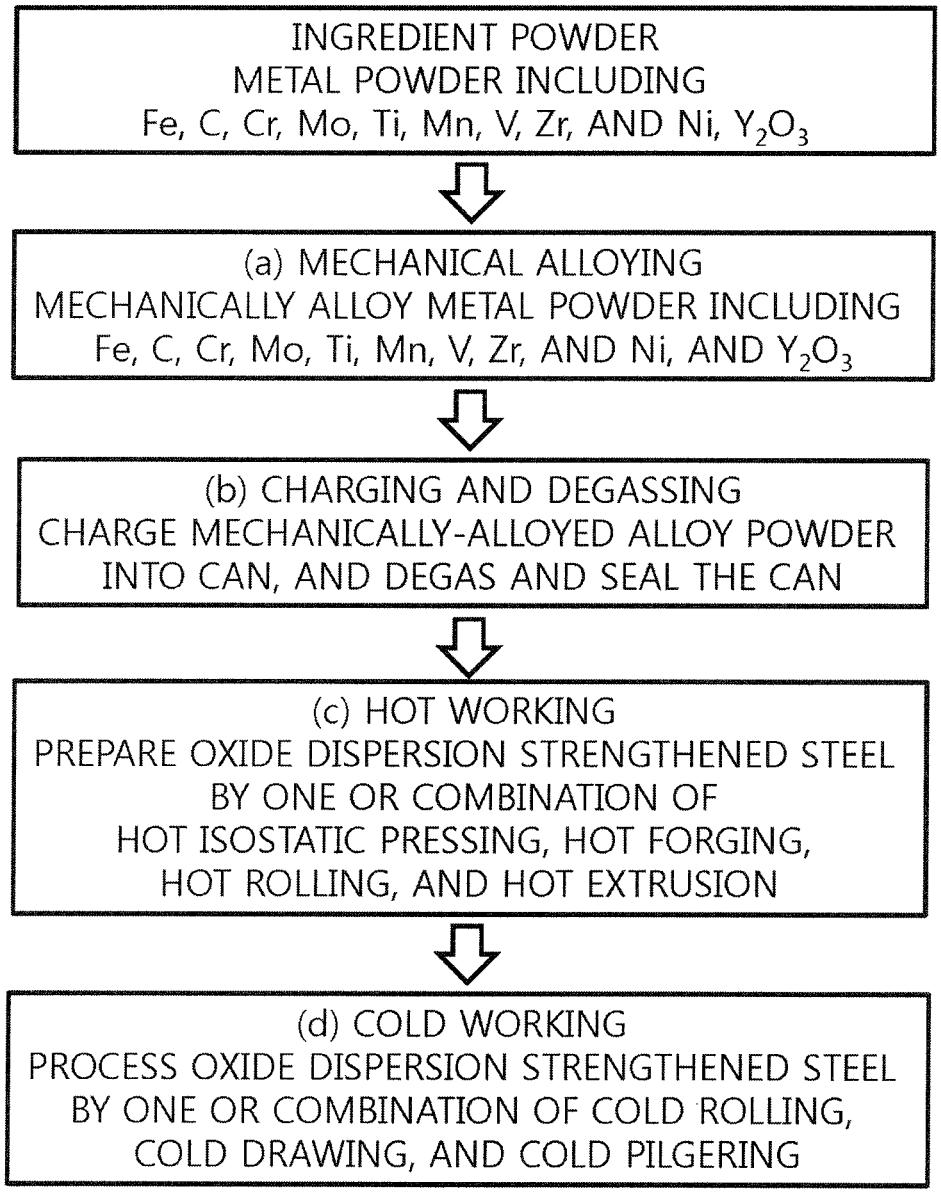
FIG. 1 is a flowchart illustrating a method of manufacturing ferritic/martensitic oxide dispersion strengthened steel according to embodiments of the present invention.

Embodiments of the present invention will be described in detail below with reference to the accompanying drawings. While the present invention is shown and described in connection with embodiments thereof, it will be apparent to those skilled in the art that various modifications can be made without departing from the spirit and scope of the invention.

Embodiments of the invention provides ferritic/martensitic oxide dispersion strengthened steel with enhanced high temperature creep resistance and neutron radiation resistance, which can be used as a core structural material of a sodium-cooled fast reactor.

As the result to study for enhancing creep resistance of oxide dispersion strengthened steel used as a material for a core structural component of a sodium-cooled fast reactor, a component for a steam generator of a thermoelectric power plant, or a material for an engine component for an airplane, the inventors confirmed that, when adding molybdenum (Mo) to a Fe—Cr—$Y_2O_3$-based oxide dispersion strengthened alloy, generation of a Laves phase is inhibited compared to the typical oxide dispersion strengthened steel, and micro distribution of carbides is enhanced by adding vanadium (V), and solid solution strengthening is enhanced by adding manganese (Mn), thereby enhancing long-term creep resistance.

Hereinafter, embodiments of the present invention will be described in detail.

Embodiments of the present invention relate to ferritic/martensitic oxide dispersion strengthened steel with excellent creep resistance, which includes carbon (C) at 0.02 to 0.2 wt %, chromium (Cr) at 8 to 12 wt %, yttria ($Y_2O_3$) at 0.1 to 0.5 wt %, molybdenum (Mo) at 0.2 to 2 wt %, titanium (Ti) at 0.01 to 0.5 wt %, manganese (Mn) at 0.01 to 1 wt %, vanadium (V) at 0.01 to 0.3 wt %, and iron (Fe) at the remaining content.

The oxide dispersion strengthened alloy may further include zirconium (Zr) and nickel (Ni), or a combination thereof, the zirconium (Zr) may further include more than 0 to 0.3 wt % or less, and the nickel (Ni) may further include more than 0 to 0.5 wt % or less.

That is, the oxide dispersion strengthened steel according to embodiments of the present invention includes all of carbon, chromium, yttria, molybdenum, titanium, manganese, vanadium, and iron, and thus ensures high creep resistance.

When a content of chromium (Cr) is equal to or more than 8 wt %, corrosion resistance may be increased, and when a content of chromium (Cr) is equal to or less than 12 wt %, the formation of a martensite phase may be facilitated. Therefore, the content of chromium (Cr) is 8 to 12 wt % in one embodiment, and 9 to 11 wt % in another embodiment.

When a content of yttria ($Y_2O_3$) is equal to or more than 0.1 wt %, a dispersion strengthening effect may be significant, and when a content of yttria ($Y_2O_3$) is equal to or less than 0.5 wt %, processability or workability may be increased as the increase of the dispersion strengthening effect due to remaining dispersion particles may be avoided or minimized. Therefore, the content of yttria ($Y_2O_3$) is 0.1 to 0.5 wt % in one embodiment, and 0.3 to 0.4 wt % in another embodiment.

When a content of molybdenum (Mo) is equal to or more than 0.2 wt %, high temperature strength may be significantly increased, and when a content of molybdenum (Mo) is equal to or less than 2 wt %, the excessive use of a plenty of high-priced molybdenum (Mo) may be avoided or minimized, thereby avoiding difficulties in an economical aspect. Therefore, the content of molybdenum (Mo) is 0.2 to 2 wt % in one embodiment, and 0.7 to 1.5 wt % in another embodiment. That is, compared to the typical oxide dispersion strengthened steel, instead of tungsten (W), molybdenum (Mo) is added, thereby increasing high temperature strength, inhibiting production of a Laves phase under a high temperature stress condition exposed to a neutron irradiation atmosphere, and enhancing a long-term creep characteristic.

A content of titanium (Ti) may be 0.01 to 0.3 wt % in one embodiment, and 0.1 to 0.3 wt % in another embodiment. Such titanium (Ti) is linked with yttria ($Y_2O_3$) during heating, thereby forming an Y—Ti—O-based mixed oxide such as $Y_2Ti_2O_7$ or $Y_2TiO_5$ to contribute to high density and micro distribution, and increase a strength.

Manganese (Mn) may serve to increase strength of a matrix by strengthening martensite as an austenite-forming element, and a content of such manganese (Mn) may be 0.01 to 1 wt %.

Vanadium (V) is a precipitation strengthening element forming a micro MX precipitate, and increases high temperature tensile strength and creep resistance. When a content of vanadium (V) is equal to or more than 0.01 wt %, the above-described effect is significant, and when a content of vanadium (V) is equal to or less than 0.3 wt %, the formation a brittle delta ferrite phase is avoided or minimized, thereby increasing a mechanical property. Embodiments of the present invention provide use of vanadium to obtain a high creep resistance. In one embodiment, the content of vanadium is 0.05 to 0.15 wt %. In another embodiment, when 0.1 wt % of vanadium (V) is used as in new alloy 4 (see Table 1), an excellent strength is ensured.

When a content of zirconium (Zr) is more than 0 to 0.3 wt % or less, it is linked with yttria ($Y_2O_3$), thereby forming an Y—Zr—O-based mixed oxide and being uniformly dispersed in a matrix to a high density, and therefore a strength characteristic may be further enhanced.

In addition, nickel (Ni) is an austenite-forming element to serve to increase strength of a matrix by strengthening martensite, and in one embodiment a content of such nickel (Ni) may be more than 0 to 0.5 wt % or less.

Accordingly, the ferritic/martensitic oxide dispersion strengthened steel of the present invention may be used as a material for a structural component including a nuclear fuel cladding, a duct, a wire, or an end plug of a fast reactor, a rotor or a shaft of an ultra supercritical pressure steam generator of a thermal power plant, or a disk or nozzle of an airplane engine.

The present invention relates to a method of manufacturing a ferritic/martensitic oxide dispersion strengthened steel with excellent creep resistance, including: (a) preparing alloy powder by mixing metal powder including carbon (C), chromium (Cr), molybdenum (Mo), titanium (Ti), manganese (Mn), vanadium (V), and iron (Fe) with yttria ($Y_2O_3$) powder, and treating the resulting mixture by mechanical alloying; (b) charging the mechanically-alloyed alloy powder into a can container and performing degassing; (c) preparing oxide dispersion strengthened steel by hot-working the degassed alloy powder; and (d) cold-working the hot-worked oxide dispersion strengthened steel.

The method of manufacturing a ferritic/martensitic oxide dispersion strengthened steel is illustrated in FIG. 1.

In addition, in the a) step, the metal powder may further include zirconium (Zr) or nickel (Ni).

In the step (a), the metal powder including carbon (C), chromium (Cr), molybdenum (Mo), titanium (Ti), manganese (Mn), vanadium (V), and iron (Fe) is mixed with the yttria ($Y_2O_3$) powder, thereby forming the alloy powder. Here, the alloy powder includes 0.02 to 0.2 wt % of carbon (C), 8 to 12 wt % of chromium (Cr), 0.1 to 0.5 wt % of yttria ($Y_2O_3$), 0.2 to 2 wt % of molybdenum (Mo), 0.01 to 0.5 wt % of titanium (Ti), 0.01 to 1 wt % of manganese (Mn), 0.01 to 0.3 wt % of vanadium (V), more than 0 to 0.3 wt % or less of zirconium (Zr), more than 0 to 0.5 wt % or less of nickel (Ni), and the remaining content of iron (Fe). After mixing the metal powder, mechanically-alloyed powder is prepared using mechanical alloying equipment such as a horizontal ball mill.

In the step (b), the mechanically-alloyed powder prepared in the step (a) is degassed in a vacuum state, and specifically, the mechanically-alloyed powder prepared in the step (a) is charged into a carbon steel or stainless steel can and sealed, and then degassed at 400 to 650° C. and $10^{-4}$ torr for 1 to 4 hours.

In the step (c), the mechanically-alloyed powder degassed in the (b) step is hot-worked, and more specifically, an oxide dispersion strengthened steel is prepared by hot isostatic pressing (HIP), hot forging, hot rolling, or hot extrusion which is used alone or in combination thereof.

In the step (d), the oxide dispersion strengthened steel prepared in the step (C) is cold-worked, and more specifically, by cold rolling, cold drawing, or cold pilgering, which is used alone or in combination thereof.

In one embodiment of the present invention, after a ferritic/martensitic oxide dispersion strengthened steel including 0.02 to 0.2 wt % of carbon (C), 8 to 12 wt % of chromium (Cr), 0.1 to 0.5 wt % of yttria ($Y_2O_3$), 0.2 to 2 wt % of molybdenum (Mo), 0.01 to 0.5 wt % of titanium (Ti), 0.01 to 1 wt % of manganese (Mn), 0.01 to 0.3 wt % of vanadium (V), more than 0 to 0.3 wt % or less of zirconium (Zr), more than 0 to 0.5 wt % or less of nickel (Ni), and the remaining content of iron (Fe) was prepared (refer to Example 1), comparing high temperature tensile strength and a creep characteristic of the ferritic/martensitic oxide dispersion strengthened steel with those of the typical oxide dispersion strengthened steel, it was confirmed that the ferritic/martensitic oxide dispersion strengthened steel of the present invention has not only a better tensile characteristic (refer to Example 2), but also a higher creep resistance (refer to Example 3) at 700° C. than the typical oxide dispersion strengthened steel.

Hereinafter, to help in understanding the present invention, examples will be provided. However, the following examples are merely provided to more easily understand the present invention, not to limit the scope of the present invention.

EXAMPLES

Example 1. Preparation of Oxide Dispersion Strengthened Steel

Ferritic/martensitic oxide dispersion strengthened steels having compositions described in Table 1 were prepared.

TABLE 1

| | Fe | C | Cr | W | Mo | Ti | Mn | Zr | Ni | V | $Y_2O_3$ |
|---|---|---|---|---|---|---|---|---|---|---|---|
| Reference alloy | Bal. | 0.12 | 9 | 2 | — | 0.25 | — | — | — | — | 0.35 |
| New alloy 1 | Bal. | 0.12 | 10 | — | 1.2 | 0.1 | 0.3 | 0.1 | 0.2 | — | 0.35 |
| New alloy 2 | Bal. | 0.12 | 10 | — | 1.2 | 0.1 | 0.6 | 0.1 | 0.2 | — | 0.35 |
| New alloy 3 | Bal. | 0.12 | 10 | — | 1.2 | 0.1 | 0.6 | 0.1 | — | — | 0.35 |
| New alloy 4 | Bal. | 0.12 | 10 | — | 1.2 | 0.1 | 0.6 | 0.1 | 0.2 | 0.1 | 0.35 |

That is, mechanically-alloyed powder was prepared by mixing high purity ingredient powder (Fe, C, Cr, W, Mo, Ti, Mn, Zr, Ni, V; particle size 200 mesh or less, purity—99% or more) with $Y_2O_3$ powder (50 nm or less, purity—99.9%) in a weight ratio using horizontal ball mill equipment (ZOZ GmbH, SIMOLOYER CM20) at a revolving speed of 240 rpm for 48 hours in a ultrahigh purity argon (Ar) atmosphere through mechanical alloying, and the mechanically-alloyed powder was charged into a stainless can and sealed, and then degassed at 400° C. in a vacuum degree of $10^{-5}$ torr or less for 3 hours. Oxide dispersion strengthened steel was prepared by treating the prepared powder-charged can at 1150° C. and 100 MPa for 3 hours through HIP, heating the resulting product again at 1150° C. for 1 hour, and treating the resulting product in a thickness-reducing ratio of 80% or more through hot rolling.

Example 2. Confirmation of Tensile Characteristic of Oxide Dispersion Strengthened Steel Yield strength, maximum tensile strength, and total elongation of the five types of the ferritic/martensitic oxide dispersion strengthened steels prepared in Example 1 were measured at room temperature and 700° C. The results are shown in FIG. 2. A tensile sample was taken to place a gage length part in parallel to a hot rolling direction of the oxide dispersion strengthened steel, and prepared according to ASTM E8. A tensile test was performed at room temperature and 700° C. and with a strain of $1\times10^{-4}$ $s^{-1}$. The tensile test was performed three times to each sample at the temperature, and an average was calculated and reflected on the result.

As shown in FIG. 2, the typical oxide dispersion strengthened steel as a reference alloy had a yield strength at room temperature of 916 MPa, the new alloys 1, 2, 3, and 4 had yield strengths of 913, 917, 921, and 927 MPa, respectively, and thus tensile strengths at room temperature seemed to be similar to each other. However, at 700° C., the typical oxide dispersion strengthened alloy as the reference alloy had a yield strength of 150 MPa, but the new alloys 1, 2, and 3 having molybdenum, titanium, manganese, and zirconium had yield strengths of 197, 192, and 193 MPa, and the new alloy 4 of the present invention further having vanadium had a yield strength of 210 MPa, which showed that the new alloys had higher high temperature tensile strength than the reference alloy.

From the result, the ferritic/martensitic oxide dispersion strengthened steel of the present invention did not have a large difference in room temperature yield strength, but a higher yield strength at 700° C., compared to the typical oxide dispersion strengthened steel.

Example 3. Confirmation of Creep Resistance of Oxide Dispersion Strengthened Steel Creep tests were performed to the five types of the oxide dispersion strengthened steels prepared in Example 1 at 700° C., and the results are shown in FIG. 3.

As shown in FIG. 3, it was confirmed that the new alloys 1, 2, 3, and 4 of the present invention were considerably increased in creep breaking time under stresses of 150 and 120 MPa, compared to the reference alloy.

From the result, it was seen that the ferritic/martensitic oxide dispersion strengthened steel of the present invention had excellent high temperature creep resistance, and excellent long-term stability, compared to the typical oxide dispersion strengthened steel.

The ferritic/martensitic oxide dispersion strengthened steel according to the present invention includes 0.02 to 0.2 wt % of carbon (C), 8 to 12 wt % of chromium (Cr), 0.1 to 0.5 wt % of yttria ($Y_2O_3$), 0.2 to 2 wt % of molybdenum (Mo), 0.01 to 0.5 wt % of titanium (Ti), 0.01 to 1 wt % of manganese (Mn), 0.01 to 0.3 wt % of vanadium (V), more than 0 to 0.3 wt % or less of zirconium (Zr), more than 0 to 0.5 wt % or less of nickel (Ni), and the remaining content of iron (Fe), and has excellent creep resistance, and thus is expected to be used as a material for core structural components (a nuclear fuel cladding, a duct, a wire, an end plug, etc.) of a nuclear power system such as a sodium-cooled fast reactor, ultra supercritical pressure steam generator components (a rotor, a shaft, etc.) of a thermal power plant, or engine components (a disk, a nozzle, etc.) of an airplane.

It will be apparent to those skilled in the art that various modifications can be made to the above-described embodiments of the present invention without departing from the spirit or scope of the invention. Thus, it is intended that the present invention covers all such modifications provided they come within the scope of the appended claims and their equivalents.

What is claimed is:

1. A steel product comprising:

a matrix of ferritic/martensitic oxide dispersion strengthened steel, the matrix comprising:

iron (Fe), 0.02 to 0.2 wt % of carbon (C), 8 to 12 wt % of chromium (Cr), 0.1 to 0.5 wt % of yttria ($Y_2O_3$), 0.2 to 2 wt % of molybdenum (Mo), 0.01 to 0.5 wt % of titanium (Ti), 0.01 to 1 wt % of manganese (Mn), 0.01 to 0.3 wt % of vanadium (V), 0.3 wt % or less but more than 0 wt % of zirconium (Zr), 0.5 wt % or less of nickel (Ni), and free of tungsten (W), wherein the ferritic/martensitic oxide dispersion strengthened steel comprises Y—Ti—O-based mixed oxide and Y—Zr—O-based mixed oxide that are dispersed throughout the matrix, wherein, with 0.2 to 2 wt % of molybdenum (Mo) and without tungsten (W), the ferritic/martensitic oxide dispersion strengthened steel is configured to inhibit generation of a Laves phase in the matrix.

2. The steel product of claim 1, wherein the ferritic/martensitic oxide dispersion strengthened steel further comprises nickel in an amount of 0.5 wt % or less.

3. The steel product of claim 1, wherein the steel product comprises one selected from the group consisting of a nuclear fuel cladding, a duct in a reactor, a wire in a reactor, an end plug in a reactor, a rotor in an supercritical pressure steam generator of a thermal power plant, a shaft in an supercritical pressure steam generator of a thermal power plant, a disk in an airplane engine, and a nozzle in an airplane engine.

* * * * *